US005384014A

United States Patent [19]

Bliss

[11] Patent Number: 5,384,014

[45] Date of Patent: Jan. 24, 1995

[54] APPARATUS AND METHOD FOR THICKENING PULP AND PAPER STOCK

[75] Inventor: Terry L. Bliss, Middletown, Ohio

[73] Assignee: The Black Clawson Company, Middletown, Ohio

[21] Appl. No.: 649,231

[22] Filed: Jan. 29, 1991

Related U.S. Application Data

[63] Continuation of Ser. No. 278,105, Nov. 30, 1988, abandoned.

[51] Int. Cl.[6] ..... B01D 33/04

[52] U.S. Cl. ..... 162/317; 162/318; 210/401; 210/402

[58] Field of Search ..... 210/401, 402, 407, 386, 210/396, 391, 318, 317; 162/55, 60, 318, 317, 300, 303; 68/22 R, 45; 8/156

[56] References Cited

U.S. PATENT DOCUMENTS

| | | | |
|---|---|---|---|
| 1,241,905 | 10/1917 | Behr | 162/318 X |
| 3,616,660 | 11/1971 | Ingermarsson | 162/318 X |
| 3,888,131 | 6/1975 | Reid | 474/189 X |
| 4,490,212 | 12/1984 | Kurtz | 162/318 X |
| 4,501,040 | 2/1985 | Biondetti et al. | 8/156 |
| 4,501,662 | 2/1985 | Biondetti | 162/203 |
| 4,663,040 | 5/1987 | Elizondo et al. | 210/402 |
| 4,686,005 | 8/1987 | Biondetti et al. | 162/60 |
| 4,740,311 | 4/1988 | Kruyer | 210/401 X |
| 4,772,793 | 2/1988 | Seifert et al. | 210/401 |

*Primary Examiner*—Thi Dang
*Attorney, Agent, or Firm*—Biebel & French

[57] ABSTRACT

Apparatus and method for thickening a suspension of solid particles in liquid employs three rolls ranged in spaced relation with their axes defining a triangle, and a single loop of wire is trained around and in wrapping relation with all three rolls. With one exception, each of the rolls has in combination therewith a headbox which delivers a flow of the suspension to be thickened in such manner that it is trapped between the wire and the portion of the roll wrapped by the wire so that the trapped suspension is dewatered and concentrated by expression of liquid through the wire. The pulp deposited on the inside of the wire at each of the stations comprising a roll and headbox is ultimately collected from the surface of the one roll having no headbox and is transported out from within the space within the wire loop. In one embodiment, the roll at each roll-headbox station has a grooved surface such that it forms separate strips of pulp on the wire, and the next roll downstream therefrom has a similar grooved surface offset axially from the preceding roll so that it causes strips of pulp to be deposited on the wire between the strips produced by the previous roll. In another embodiment, each of the rolls having an associated headbox is of the open faced type so that the layer of pulp deposited thereby on the wire is essentially continuous across the wire, and the successive open faced rolls thus lay successive uniform layers of pulp on the wire.

3 Claims, 2 Drawing Sheets

APPARATUS AND METHOD FOR THICKENING PULP AND PAPER STOCK

This is a continuation of Ser. No. 07/278,105 filed Nov. 30, 1988, now abandoned.

CROSS-REFERENCE TO RELATED APPLICATIONS

Cross-reference is made to co-owned applications, Ser. No. 229,673, filed Aug. 8, 1988, Ser. No. 229,393, filed Aug. 8, 1988, now abandoned, and Ser. No. 264,118, filed Oct. 28, 1988, now abandoned.

BACKGROUND OF THE INVENTION

The pulp and paper making industry has for many years made regular use of apparatus for thickening pulp and paper stock, usually for storage or other temporary purposes. The apparatus most commonly used in the prior art practice is known as a decker, and is relatively closely comparable in structure and mode of operation with a cylinder type paper machine, in that its main components are a wide-covered cylinder mold and a vat in which the cylinder mole rotates. In operation, the thickened pulp collects on the outer surface of the mold and is then dumped or couched therefrom for transport to a storage tank or other next station.

Deckers occupy considerable floor space, and are also relatively expensive, since the cylinder mold is a fairly complex piece of equipment, including as it does a structural framework for the filter wire. In addition, a decker is necessarily slow in operation, partly because the rotational speed of the cylinder mold must be kept below values at which centrifugal force would tend to cause the thickened pulp to be thrown off its surface, and the surface speed of cylinder molds is commonly in the range of only 200–250 feet per minute and has a practical maximum of 300 feet per minute. In general, a decker is capable of thickening feed stock of 0.7 to 1.0% consistency to a range of 4 to 6%.

Among alternatives to deckers which have been offered to the industry in recent years, particularly as a pulp washer with thickening capabilities, is apparatus constructed in accordance with Biondetti et al, U.S. Pat. Nos. 4,501,040 and 4,686,005, wherein a continuous wire loop is supported by guide rolls in such manner that it wraps a portion of a solid cylinder mounted outside the wire loop. Dilute feed stock is delivered to the wedge zone defined by the portion of the wire approaching the cylinder and the adjacent surface of the cylinder, and this suspension is dewatered by expression of liquid through the wire into a receiver mounted inside the wire loop. According to those patents, feed stock at a consistency of less than 1.5%, preferably 0.4 to 0.8%, can be thickened to a consistency of 5 to 8%.

More recently, the assignee of this application has introduced to the industry a new apparatus for thickening pulp and paper stock which has the structural and operation characteristics disclosed in Seifert et al, U.S. Pat. No. 4,722,793. The major components of the apparatus are two rolls rotatably mounted in spaced relation on parallel axes. An endless mesh-type wire belt is trained around these rolls in wrapping relation with a substantial portion of their surfaces so that the rolls and belt cooperate to define an open space bounded by the rolls and the opposed runs of the wire between the rolls.

A headbox is mounted within this space and includes an outlet which delivers the suspension to be thickened into the confined semi-annular space between one of the rolls and the portion of the wire wrapping that roll, so that the solid particles in the suspension are trapped between the wire and the roll. The rolls are driven at a sufficiently high speed to develop centrifugal force which causes liquid to be expressed from between the wire and each roll, and thereby correspondingly causes the particles carried on the inner surface of the wire to be concentrated into a pulp as it travels around each roll. Means are provided for collecting this thickened pulp from the second roll and removing it to one side of the apparatus.

The apparatus disclosed in the Seifert et al patent is capable of operating at very much higher speeds than conventional thickening apparatus of the decker type, namely speeds in the range of 1500–4000 feet per minute as compared with decker operation at a linear speed having a practical limit of 300 feet per minute. It is also capable of thickening feed stock from an input consistency of the order of 0.5% to more than 12%, and the capacity of such apparatus, in terms of tons per day of pulp, is correspondingly high.

SUMMARY OF THE INVENTION

This application is directed to improvements in the apparatus of the above Seifert et al patent which further increase the capacity of the apparatus by enhancing its efficiency in effecting the thickening of a suspension of solid particles in liquid and to a method of thickening such stock. In accordance with the invention, it has been discovered that similar thickening apparatus of significantly increased efficiency and capacity can be produced by increasing the number of rolls which are wrapped by the wire loop, and also by increasing the number of headboxes within the wire loop.

More specifically, a preferred embodiment of the invention includes substantially the same arrangement of two rolls rotatably mounted in spaced relation on parallel axes as in the above Seifert et al patent. In addition, a third roll is mounted on an axis parallel with those of the first two rolls but in a plane spaced from the plane defined by the axes of the first two rolls, so that the axes of the three rolls define a triangle, preferably an isosceles triangle with the base being the side between the axes of the first two rolls. The length of the wire loop is necessarily increased as compared with the apparatus of the Seifert et al patent, with the first two rolls mentioned above having the functions of breast roll and couch roll respectively. The path of the wire will therefore be from the breast roll to and around the third roll and thence to the couch roll.

With this form of the invention, the suspension to be thickened is supplied first to the space between the wire wrapping the breast roll and the portion of the breast roll which is wrapped by the wire. In addition, a second headbox is positioned to supply additional suspension to be thickened into the space between the wire and the portion of the surface of the third roll wrapped by the wire run reaching that roll from the breast roll.

In the improved method of this invention, initial supply of stock is dewatered as it is carried around the portion of the breast roll wrapped by the wire, so that a layer of thickened pulp is carried on the inner surface of the wire run traveling from the breast roll to the third roll, onto which layer a second supply of suspension to be thickened is deposited as the wire wraps the third roll. The resulting dual layer of concentrated particles (pulp) is further concentrated in traveling with the wire around the third roll to and around the couch roll and from which the concentrated pulp is removed and delivered to outside the space within the wire loop.

Preferred results are obtained in the operation of apparatus according to the Seifert et al patent with liquid impervious rolls when the couch roll has a grooved surface, because the grooves increase the total space between the roll surface of the wire in which partially concentrated particles can collect temporarily and from which they are then discharged by centrifugal force onto the inner surface of the wire traveling away from the roll. It has been observed in the operation of apparatus according to the Seifert et al patent which is equipped with a grooved breast roll that the accumulated pulp on the wire run traveling from the breast roll to the couch roll comprises a series of strips of pulp, each proportional in thickness to the solids concentration in the feed slurry and to the depth of the grooves in the breast roll, when they are filled to capacity, and separated by strips containing relatively little pulp and which correspond to the land areas between grooves on the breast roll.

In the practice of the present invention using liquid impervious rolls, both the breast roll and the additional or third roll are provided with grooved surfaces, and the groove patterns in the two rolls are offset with respect to each other axially of the rolls so that grooves in the breast roll are aligned in the machine direction with land areas on the third roll, and vice versa. As a result, the pulp concentrated in passing around the third roll is deposited on the wire in strips which fit between the strips of thickened pulp deposited on the wire as it leaves the breast roll. Thus the result is a substantially uniform layer of pulp extending across the width of the wire run traveling from the third roll to the couch roll.

In this embodiment of the invention, the couch roll is preferably a smooth roll, so that as the layer of pulp travels around it on the inside of the wire run from the third roll, the pulp is subjected to both centrifugal force and also to compression from wire tension. The pulp layer is therefore both compressed and further concentrated as additional liquid is expressed through the wire, and after it reaches the inside of the space and separates from the run of wire traveling from the couch roll to the breast roll, it is doctored from the couch roll and delivered to a conveyor which removes it from the space within the wire loop.

In the simplest form of the invention, the three rolls have the grooved and smooth characteristics as summarized above, but they are otherwise liquid impervious beyond the bottoms of the grooves in the breast roll and the additional roll. It is to be understood, however, that other types of rolls, including open faced rolls, may be used in the practice of the invention, essentially as shown in the above-identified application Ser. No. 264,118, the disclosure of which is incorporated herein by reference.

More specifically, while the above described combination of grooved rolls in laterally offset relation is highly effective, the use of open faced rolls at the positions of the breast roll and the additional roll offers other advantages. In particular, the use of liquid impervious rolls in the practice of the invention depends on the trapping of solid particles between the wire and the surface of each such roll, which results in the striped pattern described above. With open faced rolls, however, the layer of pulp which leaves the breast roll on the wire is of more uniform thickness, and with an open faced roll at the next station, a second relatively uniform layer of pulp will be formed on top of the first layer. In this manner, the capacity of the apparatus may be significantly increased using open faced rolls.

It is accordingly a primary object of the present invention to provide apparatus and a method for thickening a suspension of solid particles in liquid which has one or more of the features outlined above, and including specifically an arrangement of at least three rolls within an endless wire loop together with a headbox associated with each one of those rolls except one, which acts as a couch roll, and suspension to be thickened can be fed into the space between the wire and each of the rolls except the couch roll so that successive layers of pulp are concentrated on the inner surface of the wire until the pulp reaches the couch roll, whence it is removed from within the wire loop.

Other objects, features and advantages of the invention, and the means by which they are achieved and produced, will be apparent or be pointed out in the course of the detailed description of preferred embodiments of the invention which follows.

DESCRIPTION OF THE PREFERRED EMBODIMENTS

Figure 1:
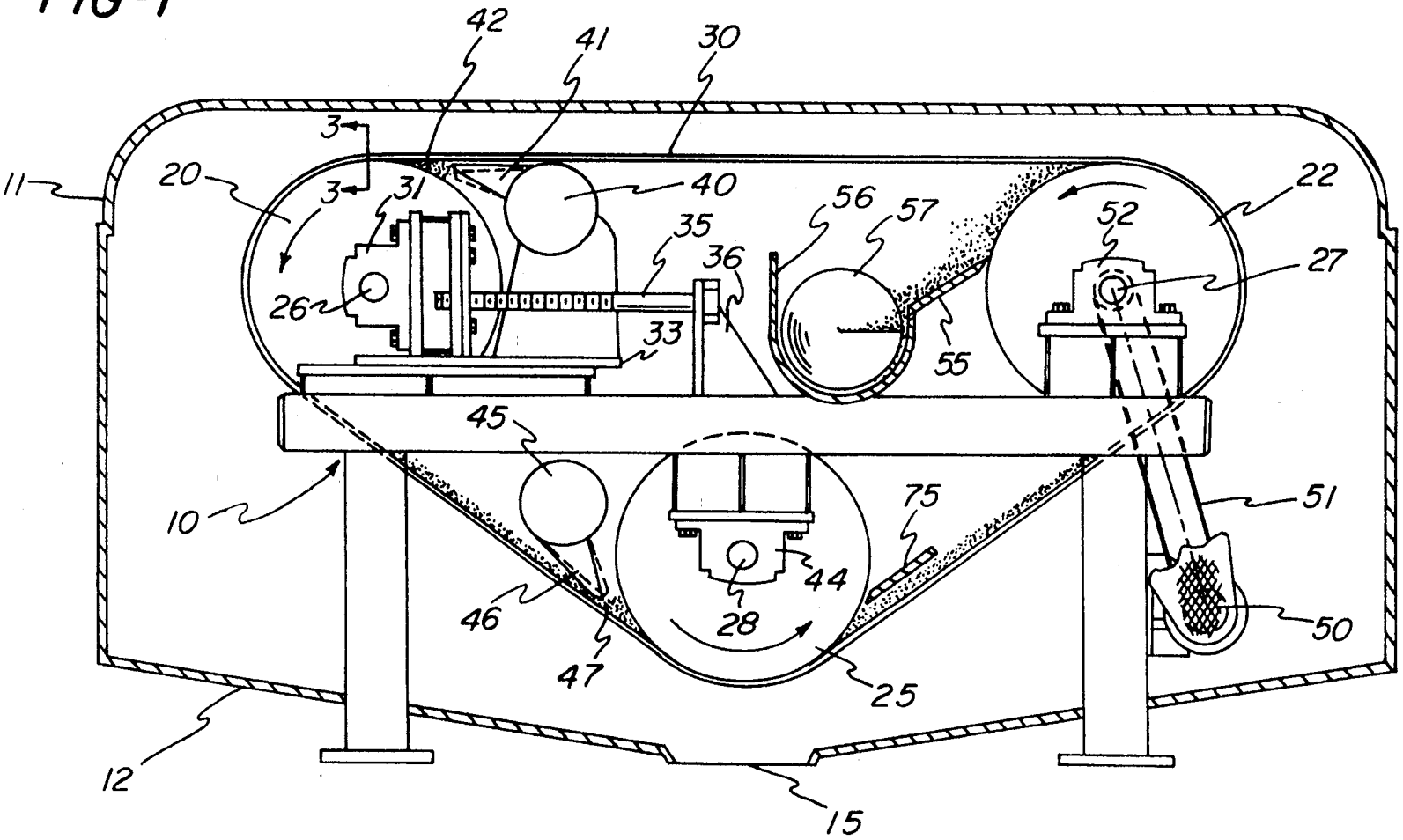
FIG. 1 is a relatively diagrammatic view in side elevation illustrating an embodiment of the invention.

The thickening apparatus of the invention as shown in FIG. 1 includes a relatively simple frame identified generally as 10, the specific structure of which is subject to wide variation without affecting the invention. Because of the extent to which liquid is thrown by centrifugal force during operation of the apparatus, it is preferably entirely enclosed in a suitable hood 11 and a bottom panel 12 which is slanted to a drain outlet 15.

The major operating elements of the apparatus are the rolls 20 and 22 which are mounted on top of the frame 10, and a third roll 25 which is mounted inside the frame 10 at a lower level than rolls 20 and 22. More specifically, the axes 26, 27 and 28 of the three rolls define an isosceles triangle having a base which coincides with the horizontal plane defined by the axes 26 and 27 of rolls 20 and 22.

An endless loop 30 or belt of foraminous "wire" is trained around the rolls 20, 22 and 25 and defines therewith a space in which the other operating parts of the apparatus are located. The wire 30 may consist of any plastic material currently used for woven paper machine wires, e.g. polyester. Also, since the product of the invention is pulp, rather than a sheet on which wire marking may be undesirable, the wire 30 may be of the pin seam type wherein the ends of the wire belt include overlapping loops that are releasably fastened together by a metal "pin" inserted through these loops. Use of pin seam wires is particularly desirable because it makes possible the changing of wires without requiring cantilevering of the rolls such as is needed if the wire is an endless loop without a seam.

Roll 20 has an adjustable mounting on the frame 10 which provides means for tensioning the wire 30. Each of the journals of the roll 20 is mounted by a pillow block bearing 31 on a base 33 which is in turn mounted for controlled sliding movement on the frame 10 toward and away from the roll 22. Jack screw means 35 connected between the base 33 and a bracket 36 secured to frame 10 cause and control this movement of roll 20 to effect corresponding variation of the tension in wire 30, which should be maintained at relatively low values in order to provide space between the surfaces of the several rolls and the portions of the wire wrapping those rolls wherein solid particles will be retained and concentrated.

The roll 20 functions similarly to the breast roll of a Fourdrinier paper machine in combination with a headbox 40 mounted in any suitable way on the same base members 33 as the roll 20 so that it maintains a fixed spacing with respect to roll 20. The headbox 40 is shown as including a tapered outlet or spout 41 for discharging a relatively flat jet of liquid suspension into the wedge zone 42 which is defined by the upper run of wire 30 approaching roll 20 and the adjacent surface of the roll itself, and which leads into the space between the portion of wire 30 wrapping roll 20 and the portion of the surface of this roll wrapped by the wire. The suspension to be thickened is fed to the headbox 40 by any convenient feed line (not shown), from any suitable stock supply pump (not shown).

The location of the third roll 25 is not critical, but the arrangement illustrated in FIG. 1 has advantages of simplicity and compactness, with the journals of the roll 25 being mounted in pillow block bearings 44 suspended from the frame 10. The headbox 45, which may be of the same construction as the headbox 40, is also mounted on the underside of frame 10 and includes a spout 46 positioned to discharge suspension to be thickened into the wedge zone 47 defined by a portion of the surface of roll 25 and the run of wire 30 approaching roll 25 from roll 20.

The roll 22 functions similarly to the couch roll of a Fourdrinier paper machine in that the mat of concentrated pulp which forms on the wire in its travel from roll 20 to roll 22 is removed from the surface of roll 25 for delivery within the space enclosed by the wire. The roll 22 also preferably serves as the drive roll for the wire 30 and therefore for the other rolls. The drive is shown as emanating from a motor 50 mounted on the frame 10 and connected through a belt drive indicated generally at 51 to the roll 22, which is mounted in pillow block bearings 52 on frame 10. The primary requirement of this drive is that it be capable of driving the wire 30, through the roll 22, at sufficiently high linear speeds, e.g. 1500–4000 feet per minute.

The thickened pulp is shown as delivered from the surface of roll 22 by a doctor blade 55 to a trough 56 having a screw conveyor 57 mounted in the bottom thereof to propel the collected pulp to the back of the apparatus from inside the space enclosed by the wire 30. The doctor blade 55 may be of any conventional type, but it is preferably of the non-contacting characteristics disclosed in the above-identified application Ser. No. 229,673, the disclosure of which is incorporated herein by reference.

Figure 3:
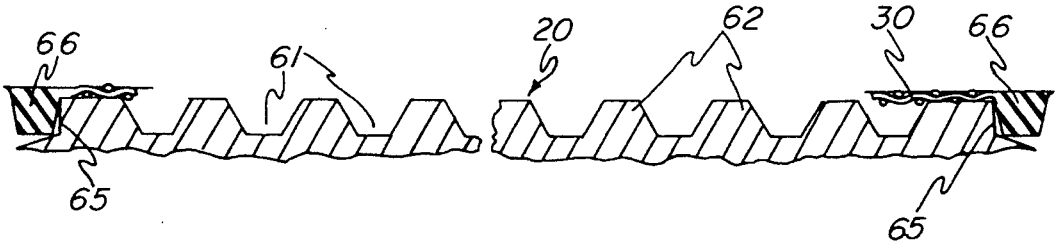
FIG. 3 is a fragmentary view in axial section taken on the line 3—3 in FIG. 1 and illustrating a typical groove pattern for use on the grooved rolls shown in FIG. 2.

As already noted, in one preferred embodiment of the invention, the couch roll 22 is a smooth surfaced roll, but both of the rolls 20 and 25 have circumferentially grooved surfaces. Thus FIG. 3 shows a fragment of the outer portion of roll 20 as comprising a solid shell 60 provided on its outer surface with multiple circumferential grooves 61 separated by circumferential land portions 62. For strength purposes, these lands and grooves have in axial section the outlines of truncated pyramids, with all corners rounded about a small radius to reduce wear on the wire and to minimize possible collection of fiber in the corner of a groove.

As illustrated in FIG. 3, the grooves 61 provide spaces in which to receive and carry stock around that portion of the rotation of roll 20 wherein it is wrapped by the wire, and the capacity of the apparatus is related to the cross sectional area of each of these grooves. There is no theoretical basis for limiting the dimensions of each groove, but as an example, satisfactory results have been obtained with each groove having an inner width of 0.5 inch and an outer width of 1.0 inch, and with each land 62 having a minimum width of 0.30 inch. Right angled shoulders 65 at the opposite ends of roll 20 cooperate with guide belts 66 on the outer edges of the wire to maintain the wire running straight in accordance with the above-identified application Ser. No. 229,393, the disclosure of which is incorporated herein by reference. As an alternative to circumferentially arranged grooves, it may be desirable to provide one or more of rolls 20, 22 and 25 with helical grooves which spiral in opposite directions from the center of the roll in order to impart a lateral stretching action to the wire, and to avoid repetitious and concentrated wire wear at points axially aligned with the corners of the land areas.

It has been observed in the operation of apparatus in accordance with the above-identified Seifert et al patent incorporating a grooved breast roll that thickened pulp is deposited on the run of the wire leaving the breast roll in a series of strips 71 of substantial thickening which are essentially in line with the grooves 61 in the breast roll. These relatively thick strips 71 of pulp are separated by strips 72 which are aligned with the lands on the breast roll and usually contain relatively few solid particles.

The roll 25 to which the wire travels from breast roll 20 is preferably provided with a similarly grooved surface, but with the groove pattern axially offset with respect to that on the breast roll 20 so that the grooves 61 in roll 25 are substantially aligned in the machine direction with the lands 62 on roll 20. In other words, the pattern of pulp on the run of the wire from roll 20 to roll 25 will look much like the pattern of lands and grooves shown in FIG. 3, with strips of pulp similar in section to the lands 62 which will be aligned in the machine direction with the grooves 61 in roll 20 and will be separated by open strips 72 in line with the lands 62 on roll 20.

The operation of the grooved roll 25 is similar to that of roll 20 but complementary thereto by reason of the axially offset relation of the grooves and lands thereon with respect to those on roll 20. Thus roll 25 will similarly create laterally spaced strips of thickened pulp on the run of the wire traveling to the couch roll 22, but these strips will be so aligned with the relatively bare strips 72 on the run of wire approaching from roll 20 to provide an essentially continuous mat of pulp across the run of the wire from roll 25 to roll 22, as illustrated at 73 in FIG. 2.

At the station of roll 25, the strips of pulp already on the wire which pass between the wire and the lands 62 on roll 25 will be further dewatered and compressed by the combination of centrifugal force and the pressure generated by wire tension. If there is any tendency of these compressed strips to transfer from the wire to the lands 62 on roll 25, this can be counteracted by a doctor 75, preferably of the same non-contacting type as doctor blade 55, which in combination with centrifugal force will assure that all pulp thickened by passage with the wire around roll 25 will continue to travel on the wire to roll 22.

Figure 2:
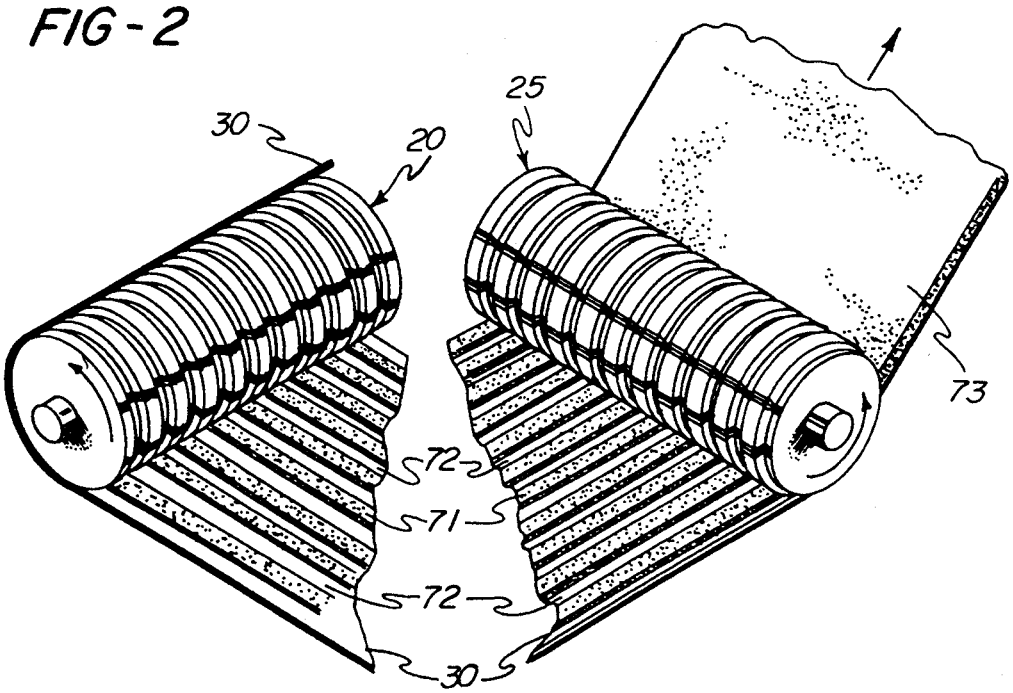
FIG. 2 is a somewhat schematic view in perspective further illustrating the operation of the apparatus of FIG. 1 using grooved rolls at the positions of the breast roll and the additional roll.

The practical result of the operation of the apparatus as described in connection with FIGS. 1–3 is to provide three stages of thickening action which will take place at high speed and with correspondingly high gallonages of feed stock. More specifically, the dewatering action at the station of couch roll 20 will be essentially the same as with the two-roll apparatus disclosed in the Seifert et al patent, and the thickened pulp traveling on wire 30 from roll 20 to roll 25 will be subjected to further dewatering, by both centrifugal force and wire tension pressure, as it travels around roll 25.

At this second station, the additional gallonage from headbox 45 may essentially duplicate the output of headbox 40, so that for this additional gallonage, the dewatering action is comparable to that which occurred at the first dewatering station around roll 20. While the degree of wrap of roll 25 by the wire is shown in FIG. 1 as less than the extent of wrap of the roll 20, this will have no significant effect on the capacity of the apparatus as a whole. Further, the mixture of pulp from both headboxes on the wire run from roll 25 to roll 22 will again be subjected to dewatering by the combination of centrifugal force and wire tension pressure until the wire leaves roll 22.

There is no theoretical limit to the ability of the apparatus of the invention to receive and thicken any feed suspension of sufficiently low consistency to be pumpable through the headboxes 40 and 45, e.g. consistencies up to 5%, and the consistency of the pulp removed from the couch roll 22 will depend upon the feed consistency but in every case will be substantially higher than can be obtained with conventional thickeners. For example, if the feed consistency is 0.5%, an output consistency of 20% can readily be obtained, while if the feed consistency is 4%, the output consistency may be as high as 25%. Thus the apparatus of the invention adds versatility with respect to the nature and consistency of feed stocks to its outstanding characteristics of high capacity and high dewatering efficiency.

Figure 4:
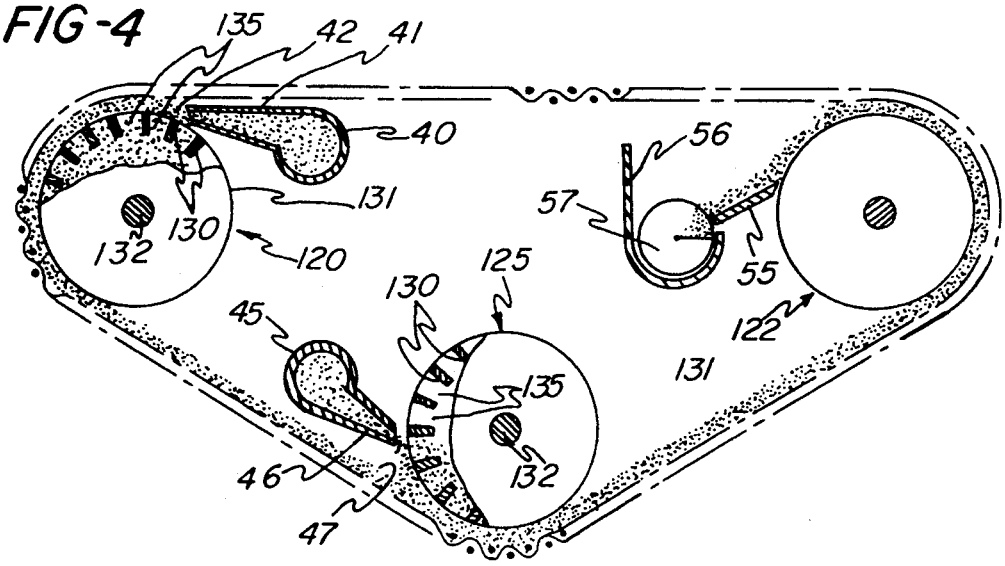
FIG. 4 is a fragmentary view illustrating a modification of the apparatus of FIG. 1 wherein open-faced rolls are used.

FIG. 4 represents a modification of the apparatus described in connection with FIGS. 1–3 wherein open-faced rolls 120 and 125 are located in the positions of rolls 20 and 25 in FIG. 1, while the couch roll 122 is shown as a solid roll. The rolls 120 and 125 are representative of open-faced rolls which may be used in the practice of the invention, in accordance with the principles disclosed in the above-identified application Ser. No. 264,118.

Thus each of these rolls 120 and 125 is shown as having a discontinuous outer surface comprising multiple relatively flat bars 130 supported at their opposite ends by heads 131 which are in turn mounted for rotation in the same manner as rolls 20 and 25 by journals 132. The bars 130 are arranged in circumferentially spaced relation to provide slot-like openings 135 therebetween, and they may also be supported at positions intermediate their ends by suitable disk or head members, as may be needed. It is to be understood that the spacing of adjacent bars 130 should be such that the slots 135 are substantially wider than the largest particles in the supply suspension to be thickened.

In operation, and as illustrated in FIG. 4, the jet of feed stock from the headbox outlet 41 is directed generally into the wedge zone 42 and also at some of the slots 135 so that it will enter the chamber inside the roll by way of these slots. Some of this stock will impinge directly on the wire and be immediately partially dewatered because the force of the jet causes liquid to travel through the wire. A considerable volume of the stock will pass directly into the interior of the roll 130, but with the roll rotating at the relatively high surface speeds noted above, whatever stock enters the interior of the roll through slots 135 will immediately be subjected to correspondingly high centrifugal force, since the bars 130 will act like a paddle wheel.

Thus both its initial discharge velocity from the headbox and the centrifugal forces will cause the stock to pass rapidly through roll 120 and to impinge on the inside of the portion of the wire wrapping this roll. Since only the wire then prevents free centrifugal discharge of the stock from within roll 120, the continuous application of centrifugal force causes the liquid component of the stock to be expressed through the wire while the solid particles suspended therein are held by the wire and compressed into a pulp layer on its inner surface.

This results in the formation of a relatively continuous layer of thickened pulp, which may have a striped pattern across the wire, and which will travel on the wire to the roll 125, where the same action is repeated with respect to the additional flow of suspension from the headbox 45. At this station, the new supply flow of suspension is dewatered, the previously dewatered layer of pulp is further dewatered, and the resulting doubled layer of thickened pulp will be carried by the run of wire from roll 125 to the couch roll 122, which is preferably solid like roll 22 but may also be open faced as explained in application Ser. No. 264,118. There it is again further dewatered by the combination of centrifugal force and the pressure of wire tension prior to delivery to the conveyor 56-57 as described in connection with FIG. 1.

The particular arrangement of rolls illustrated in FIG. 1, with the rolls 20 and 22 having their axes in the same horizontal plane and the roll 25 being located equidistant from and below the plane defined by the axes of rolls 20 and 22, is advantageous, particularly in its simplicity, but the invention is not limited to such an arrangement or orientation of the roll axes. For example, and as disclosed in the above application Ser. No. 264,118, the plane defined by the horizontal axes of the rolls 20 and 22 may be in any orientation to the vertical, from the right angled relation as shown to coincidence with the vertical, and further the axes of the three rolls may be vertical or at any desired angle between the vertical and the illustrated horizontal arrangement and the vertical. In addition, any of the roll combinations shown in that application may be utilized in an embodiment of the present invention, and as noted above, the disclosure of that application is incorporated herein by reference.

Since the thickening apparatus of the invention was developed for use in the treatment of suspensions of paper making fibers in water, it has been described with specific reference thereto. It is to be understood, however, that the apparatus and method of the invention could be used to thicken suspensions of other solid particles in liquid, such for example as sludges and the like, and the use of the term "pulp" herein is to be understood as applying to any such suspensions.

While the forms of apparatus and methods herein described constitute preferred embodiments of the invention, it is to be understood that the invention is not limited to these precise forms of apparatus and methods and that changes may be made therein without departing from the scope of the invention which is defined in the appended claims.

What is claimed is:

1. Apparatus for thickening a suspension of solid particles in liquid, comprising:

(a) means defining a frame, (b) first, second and third rolls rotatably mounted in spaced relation in said frame on substantially parallel horizontal axes which define a triangle, (c) an endless wire belt trained around said rolls for travel from said first roll to said second and third rolls in wrapping relation with a limited angular portion of the surface of each thereof and thereby defining a space bounded by said belt wherein all of said rolls are enclosed by said belt and the remaining portion of each said roll not wrapped by said belt is bare and defines a wedge zone with the portion of said belt approaching said roll, (d) each of said first and second rolls having a discontinuous surface providing spaces enclosed by the portions of said belt wrapping said rolls, said discontinuous surface comprising multiple circumferential grooves separated by circumferential land portions to provide space in said grooves for receiving said suspension while said grooves are enclosed by said land portions and by said wire, wherein the surface of said first roll comprises helical grooves which spiral in opposite directions from the center of said roll, (e) headbox means positioned to direct a flow of said suspension into said wedge zone at a first of said rolls whereby said suspension is initially confined in said grooves in said first roll surface by the portion of said belt wrapping said first roll, (f) means for driving at all of said rolls and said wire at a speed sufficiently high to effect the development of centrifugal force causing liquid in said confined suspension to be expressed outwardly through said belt and thereby causing said particles in said confined suspension to be retained and to form a discontinuous layer of pulp alternating with open areas on the inner surface of said belt as said belt separates from said first roll for travel to said second roll, (g) additional headbox means positioned to direct an additional flow of said suspension into said wedge zone at said second roll whereby additional solid particles form pulp deposits in said open areas on the inner surface of said belt in consolidated relation with said discontinuous pulp layer thereon as said belt separates form said second roll for travel to said third roll, (h) means associated with said third roll for causing said consolidated pulp to transfer from said belt to said bare portion of the surface of said third roll, and (i) means mounted in said space for collecting said transferred pulp from said third roll and removing said collected pulp from said space.

2. Thickening apparatus as defined in claim 1 wherein the surface of said second roll comprises helical grooves which spiral in opposite directions from the center of said second roll.

3. Apparatus for thickening a suspension of solid particles in liquid, comprising:

(a) means defining a frame, (b) first and second rolls rotatably mounted in spaced relation in said frame on substantially parallel axes which thereby define a plane, (c) a third roll mounted in said frame on an axis parallel with said first and second roll axes but spaced from said plane whereby said three axes define a triangle, (d) an endless wire belt trained around said rolls in wrapping relation with a portion of the surface of each thereof and cooperating therewith to define a space enclosing said rolls and bounded by the runs of said wire therebetween, (e) the path of said wire being from said first roll to said third roll and then to said second roll, (f) headbox means positioned to supply a flow of said suspension between the portion of said wire wrapping said first roll and the portion of the surface of said first roll wrapped by said wire, (g) means for driving one of said rolls to cause said wire to travel around said rolls at at a speed effecting the development of centrifugal force causing liquid to be expressed through the portion of said wire wrapping each of said rolls and thereby converting to pulp the solid particles in said suspension carried on the inner surface of said wire around said three rolls in succession.

(h) second headbox means positioned to supply an additional flow of said suspension between the portion of said wire wrapping said third roll and the portion of the surface of said third roll wrapped by said wire for conversion by dewatering into additional pulp deposited on the run of said wire traveling away from said third roll, (i) means associated with each of said first and third rolls for causing said pulp to remain on said wire as said wire departs from each of said first and third rolls, (j) means mounted in said space in position to collect said pulp from the surface of said second roll, and (k) further characterized in that said first and third rolls are liquid impervious, the surface of said first roll comprises multiple circumferential grooves separated by circumferential land portions, whereby said pulp carried on said wire from said first roll to said third roll is arranged in strips aligned with said grooves and separated by spaces aligned with said lands, the surface of said third roll comprises multiple circumferential grooves and lands of substantially the same axial dimensions as said grooves and lands in said first roll surface, and said grooves in said third roll surface are substantially aligned with said lands in said first roll surface whereby said additional pulp is formed on said wire into strips in said open spaces between said strips of pulp carried to said third roll from said first roll.

* * * * *